US012790707B2

(12) United States Patent
Parker

(10) Patent No.: US 12,790,707 B2
(45) Date of Patent: Nov. 10, 2026

(54) "GOLDEN"—GOLD NANOMATERIALS

(71) Applicant: AG-NANO SYSTEM LLC, Sterling Heights, MI (US)

(72) Inventor: Margaret Eva Parker, Escondido, CA (US)

(73) Assignee: AG-NANO SYSTEM LLC, Sterling Heights, MI (US)

( * ) Notice: Subject to any disclaimer, the term of this patent is extended or adjusted under 35 U.S.C. 154(b) by 0 days.

(21) Appl. No.: 19/400,914

(22) Filed: Nov. 25, 2025

(65) Prior Publication Data

US 2026/0146355 A1 May 28, 2026

Related U.S. Application Data

(60) Provisional application No. 63/724,793, filed on Nov. 25, 2024.

(51) Int. Cl.

| | |
|---|---|
| ***C25D 3/48*** | (2006.01) |
| ***C25D 5/12*** | (2006.01) |
| ***C25D 5/34*** | (2006.01) |
| ***C25D 21/12*** | (2006.01) |

(52) U.S. Cl.

CPC ..... *C25D 3/48* (2013.01); *C25D 5/12* (2013.01); *C25D 5/34* (2013.01); *C25D 21/12* (2013.01)

(58) Field of Classification Search

None

See application file for complete search history.

(56) References Cited

U.S. PATENT DOCUMENTS

| | | | | |
|---|---|---|---|---|
| 3,589,914 | A * | 6/1971 | McCormcak | A23L 7/117 426/558 |
| 2006/0054406 | A1 * | 3/2006 | Delaloye | F01D 25/18 184/6.11 |

* cited by examiner

*Primary Examiner* — Louis J Rufo

(57) ABSTRACT

A method and system for electroplating "Golden" gold nanoparticles (Nano-Au25) are disclosed. The process employs sequential substrate preparation, nickel and gold strike deposition, followed by formation of a reduced-thickness gold layer and a nanoparticle layer produced from a gold phosphate electrolyte containing sodium borohydride. The deposition is carried out at a pH of 12-14 and a temperature of 140-160° F., achieving a rate of 3-4 μm/h under controlled current density. A feedback-controlled electroplating apparatus monitors pH, temperature, and current in real time to ensure uniform nanoparticle growth. The resulting dual-layer coating provides enhanced conductivity, durability, and material efficiency while maintaining compliance with industry gold-plating standards, rendering it suitable for high-performance electronic connectors and semiconductor applications.

6 Claims, 6 Drawing Sheets

"GOLDEN"—GOLD NANOMATERIALS

FIELD OF THE INVENTION

The present invention generally relates to the fields of metallurgy, nanotechnology, and electrochemistry. More particularly, the present invention relates to the production of gold nanoparticles via electroplating methods for applications in electronics and semiconductor devices, including microchips, connectors, and electronic sensors.

BACKGROUND OF THE INVENTION

The demand for gold nanoparticles in electronics and semiconductor applications, including microchips, connectors, and electronic sensors, has experienced significant growth driven by advancements in technology and the ongoing miniaturization of electronic components. Electroplated layers of gold nanoparticles are well-regarded for their distinctive electronic properties, including high electrical conductivity and chemical stability, which make them particularly advantageous for enhancing the performance of semiconductor devices.

Despite their advantages, the production of gold nanoparticles through traditional electroplating methods presents several significant challenges. Firstly, the high costs of materials used in gold deposition create economic barriers, particularly in the highly competitive semiconductor industry. Secondly, conventional methods impose stringent requirements on the thickness of gold coatings, often necessitating substantial material usage that leads to inefficient utilization and increased production costs. Thirdly, achieving uniform deposition over complex geometries remains a persistent challenge, which can compromise the performance and reliability of electronic components.

Thus, there is a need to develop a method to solve such problems by providing a more efficient and cost-effective technique for producing gold nanoparticle layers. The present invention addresses this need by reducing the required thickness of traditional crystalline gold layers by at least 50% while subsequently applying a thin layer of gold nanoparticles, referred to as Nano-Au25. This innovative approach not only complies with ASTM B488-11 standards and related specifications but also facilitates enhanced performance in electronic applications through optimized material usage and cost reduction.

The present invention is intended to solve the problems associated with conventional methods and provide improvements on these methods.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

The present invention provides a method for the electrodeposition of gold nanoparticles, referred to herein as "golden" gold nanoparticles and designated as Nano-Au25.

This innovative process employs a gold phosphate solution with a borohydride additive as the electrolyte, facilitating optimized reduction-oxidation (redox) reactions. Characterization of these reactions has been performed using potentiometric and cyclic voltammetry techniques, ensuring precise control over the synthesis parameters.

As a result, the method yields uniform, high-quality nanoparticles with defined nanometric sizes. These Nano-Au25 nanoparticles exhibit significantly enhanced material properties, including improved electrical conductivity, chemical stability, and performance in electronic applications.

This novel approach addresses the challenges associated with traditional gold deposition methods by enabling the production of high-performance nanoparticles while effectively reducing material costs and thickness requirements.

DETAIL DESCRIPTIONS OF THE INVENTION

Figure 1:
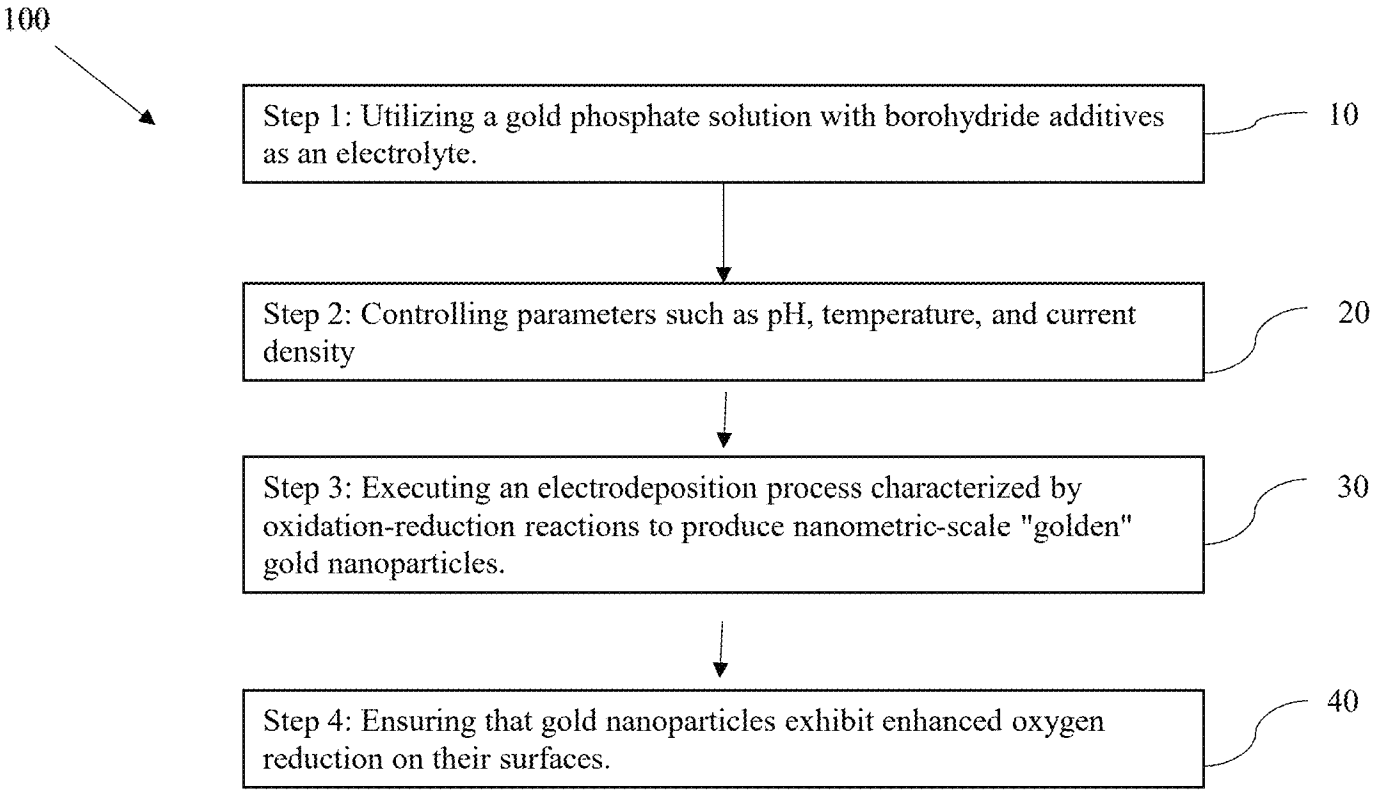
FIG. 1 is a schematic flow diagram illustrating the sequence of process steps for electroplating "Golden" gold nanoparticles (Nano-Au25) of the present invention.

All illustrations of the drawings are for the purpose of describing selected versions of the present invention and are not intended to limit the scope of the present invention.

As a preliminary matter, it will readily be understood by one having ordinary skill in the relevant art that the present disclosure has broad utility and application. It should be understood that any embodiment may incorporate only one or a plurality of the above-disclosed aspects of the disclosure and may further incorporate only one or a plurality of the above-disclosed features. Furthermore, any embodiment discussed and identified as being "preferred" is considered to represent the best mode contemplated for carrying out the embodiments of the present disclosure. Other embodiments may be discussed for illustrative purposes, providing a full and enabling disclosure of the invention.

Moreover, many embodiments, such as adaptations, variations, modifications, and equivalent arrangements will be implicitly disclosed by the embodiments described herein and will fall within the scope of the present disclosure. Accordingly, while embodiments are described herein in detail in relation to one or more embodiments of methods and systems for the electrodeposition of "Golden" gold nanoparticles (Nano-Au25) for enhanced semiconductor and electronic applications, it is to be understood that this disclosure is illustrative and exemplary of the present invention and is made merely for the purpose of providing a full and enabling disclosure.

The detailed discussion herein of one or more embodiments is not intended, nor should it be construed, to limit the scope of patent protection afforded in any claims of a patent issuing herefrom, which scope is to be defined by the claims and their equivalents. It is not intended that the scope of patent protection be defined by reading into any claim limitation found herein and/or issuing herefrom that does not explicitly appear in the claim itself.

Thus, for example, any sequence(s) and/or temporal order of steps of various processes or methods that are described herein, including the activation of substrate surfaces, electroplating, and nanoparticle deposition, are illustrative and not restrictive. Accordingly, it should be understood that while steps of various processes or methods may be shown and described as being in a specific sequence or temporal order, the steps of such processes or methods are not limited to being carried out in any particular sequence or order, absent an indication otherwise. Indeed, the steps in such processes or methods may generally be carried out in various different sequences and orders while still falling within the scope of the present disclosure. Accordingly, it is intended that the scope of patent protection is to be defined by the issued claims rather than the descriptions set forth herein.

Additionally, it is important to note that each term used herein refers to that which an ordinary artisan would understand the term to mean based on the contextual use of such a term herein. To the extent that the meaning of a term used herein—as understood by the ordinary artisan based on the contextual use of such a term—differs from any dictionary definition of such term, it is intended that the ordinary artisan's understanding should prevail.

Furthermore, it is important to note that, as used herein, "a" and "an" generally denote "at least one," but do not exclude a plurality unless the contextual use dictates otherwise. When used herein to join a list of items, "or" denotes "at least one of the items," but does not exclude a plurality of items from the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing herefrom. The present disclosure contains headers. These headers are used as references and are not to be construed as limiting upon the subject matter disclosed under the header.

The present disclosure includes many aspects and features. Moreover, while many aspects and features relate to, and are described in the context of methods, systems, apparatuses, and devices for the electrodeposition of "Golden" gold nanoparticles (Nano-Au25) for use in electronics and semiconductor applications, embodiments of the present disclosure are not limited to use only in this context.

The present invention discloses a novel method for the production of "golden" gold nanoparticles (Nano-Au25) through an advanced electroplating technique. This innovative method is designed to enhance the intrinsic performance characteristics of the nanoparticles while simultaneously achieving a significant reduction in material usage. Such advancements not only contribute to environmental sustainability but also enhance the scalability of production processes. This efficiency in material consumption directly translates to lowered production costs, thereby improving the economic feasibility of employing gold nanoparticles in semiconductor applications.

The present invention meticulously optimizes the deposition process, ensuring uniform distribution of nanoparticles and precise control over their thickness. These enhancements are critical for meeting the stringent requirements of next-generation high-performance electronic devices. By addressing the limitations of traditional gold deposition methods, the present invention provides a robust solution that supports the advancement of semiconductor technology through improved material efficiency and cost-effectiveness.

A method of the present invention to produce "Golden-Gold Nanomaterials Nano-Au25" is as follows: The method includes activating the surface of a substrate using a soak cleaner followed by rinsing the substrate. An activator solution is applied, followed by rinsing with an ammonia dead rinse solution. The substrate is then conditioned using a second rinse, and the surface is etched using hydrochloric acid. Following the etching step, a third rinse is performed before depositing electrolytic nickel metal onto the substrate. This is followed by the electrodeposition of a gold strike metal onto the surface of the substrate, and then electrodeposition of a gold layer with a 50% reduction in thickness compared to traditional methods. Finally, the "Golden-Gold Nanomaterials—Nano-Au25" layer is electrodeposited onto the surface of the substrate using a specially formulated electroplating solution.

In certain embodiments, the substrate comprises connectors or components made of beryllium copper (BeCu) alloys, which are widely used in high-performance electronic connectors. The process parameters described herein are optimized for such beryllium- copper substrates.

Method Overview

The present invention provides a method comprising the following steps:

1. Surface Activation of a Substrate:
   The method commences with the activation of the surface of a substrate utilizing a soak cleaner specifically developed to remove surface contaminants and prepare the substrate for subsequent processing. Following activation, the substrate undergoes a thorough rinsing to eliminate any residual cleaning agents, ensuring an optimal surface condition for adhesion of subsequent layers.
2. Application of Activator Solution:
   An activator solution is then applied to the cleaned substrate. This solution is designed to further enhance the substrate's surface characteristics, fostering improved electroplating outcomes. After the application of the activator, the substrate is rinsed again using an ammonia-based dead rinse solution to ensure the removal of any reactive species and enhance substrate readiness.
3. Conditioning of the Substrate:
   Following the activation steps, the substrate is conditioned with a secondary rinse.
   This rinse improves the substrate's overall reactivity, ensuring it is adequately prepared for the effective electrodeposition of metallic layers that follow.
4. Etching with Hydrochloric Acid:
   The substrate surface is then subjected to etching using hydrochloric acid, which effectively modifies the surface morphology. This etching process increases the surface roughness and enhances the adhesion characteristics for the subsequent metallic depositions.
   The substrate surface is etched using hydrochloric acid (15% w/v). In one embodiment, the etching bath is maintained at an elevated temperature of approximately 120° F. to 140° F. to enhance etching efficiency and improve adhesion of subsequent layers. Following the etching step, a third rinse is performed to remove any remaining acid that could hinder later processes.

5. Electrolytic Nickel Deposition:
   Next, an electrolytic nickel metal layer is deposited onto the substrate, forming a conductive foundation essential for subsequent gold electrodeposition. As depicted in FIG. 1-A, this nickel layer significantly enhances the interfacial adherence of the gold to the substrate, contributing to improved conductivity throughout the final assembly.
6. Electrodeposition of Gold Strike Metal:
   Following the nickel deposition, a gold strike metal layer is electrodeposited onto the surface of the substrate. This initial layer of gold is critical for ensuring an even deposition of the thicker gold layer that follows, establishing a reliable interface for the more substantial gold coating.
7. Electrodeposition of a Thinner Gold Layer:
   The gold layer thickness is reduced by at least 60% compared to traditional methods, yielding significant material savings.
   In some embodiments, the thickness reduction ranges from 50% to 65% compared to standard gold plating thicknesses.
8. Electrodeposition of Golden Gold Nanoparticles (Nano-Au25):
   Finally, the "golden" gold nanoparticles (Nano-Au25) are electrodeposited onto the surface of the substrate using a specially formulated solution.
   In certain embodiments, the deposition rate of the Golden-Nano-Particles layer is 3.0-4.0 μm/h with a direct current (DC) density of 1.0-3.0 ASF. The electroplating process utilizes an optimized electrolytic bath maintained at a pH of 12-14 to ensure consistent nanoparticle growth.
   In one manufacturing embodiment, the current method 100 may include the following embodiment steps as illustrated in FIG. 1:

Step 1: Utilizing a gold phosphate solution with borohydride additives as an electrolyte at 10.

Step 2: Controlling parameters such as pH, temperature, and current density at 20.

Step 3: Executing an electrodeposition process characterized by oxidation-reduction reactions to produce nanometric-scale "golden" gold nanoparticles at 30.

Step 4: Ensuring that gold nanoparticles exhibit enhanced oxygen reduction on their surfaces at 40.

Figure 2:
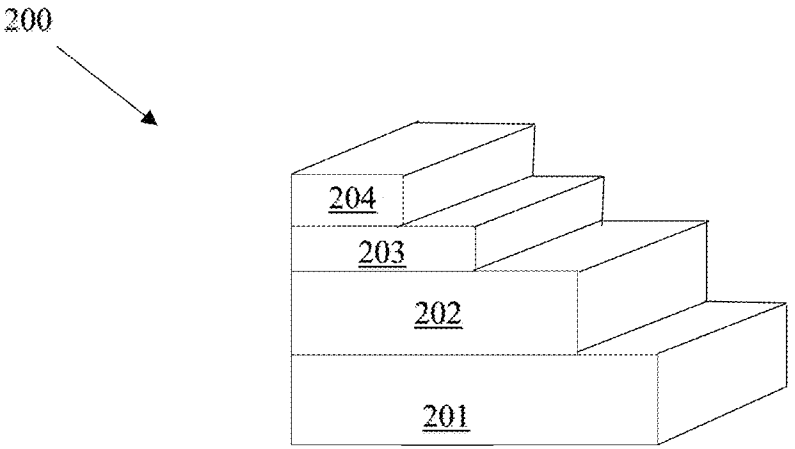
FIG. 2 is an illustration of a conventional gold electroplating configuration.

FIG. 2 illustrates the structure of a conventional gold electroplating system 200 commonly used in the industry. The system 200 includes a base copper-alloy substrate 201, such as beryllium copper or phosphor bronze, over which an electrolytic nickel layer is deposited to a thickness of approximately 2.5 μm. A thin gold strike layer 203, typically about 0.14 μm thick, is applied to promote adhesion, followed by a full-thickness gold layer 204 with a nominal thickness of 1.25 μm (50 microinches) in accordance with ASTM B488 standards.

This configuration, while providing reliable conductivity and corrosion protection, results in high gold consumption and limited nanoscale functionality.

Figure 3:
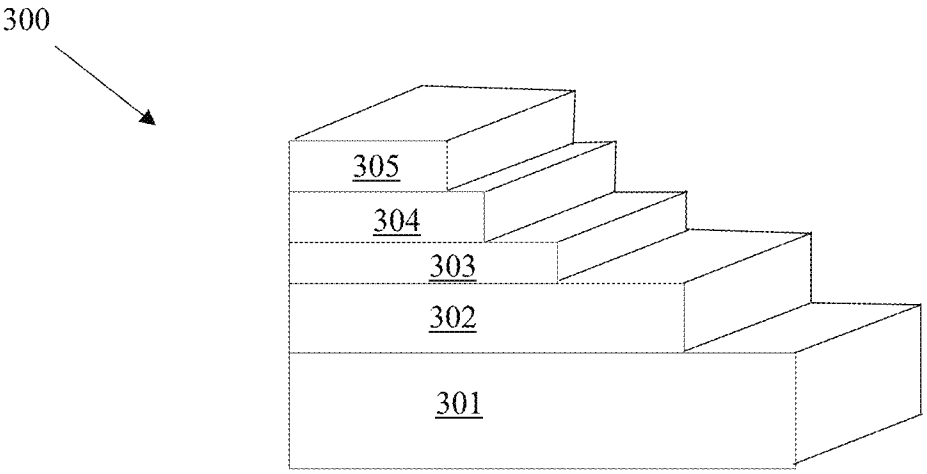
FIG. 3 is an illustration of an improved dual-layer structure according to the present invention.

In contrast, FIG. 3 depicts the improved layer configuration produced by the current method of the present invention.

In this embodiment, a similar substrate and nickel base 302 are used, followed by the same 0.14 μm gold strike layer 303. However, the subsequent gold layer 304 is significantly reduced in thickness to about 0.625 μm, representing a reduction of approximately 50 percent compared to standard deposits. Over this reduced-thickness gold layer 304, the Nano-Au25 layer 305 is electrodeposited to a thickness of approximately 0.075 μm (3 microinches). The Nano-Au25 layer 305 includes evenly distributed nanometric "golden" particles created by the aforementioned gold-phosphate/borohydride electroplating process. Electrochemical analysis indicates that this surface exhibits enhanced charge-transfer characteristics and surface reactivity, with cyclic voltammetry confirming efficient reduction kinetics and stable redox potentials.

Comparative studies between FIG. 2 and FIG. 3 show that the new dual-layer structure achieves equivalent or improved electrical and mechanical performance while reducing the total gold content by approximately 50 to 60 percent. The nickel underlayer continues to provide diffusion resistance and structural integrity, while the reduced-thickness gold layer ensures electrical continuity.

The Nano-Au25 surface layer 305 enhances contact reliability through its nanoscale grain morphology, which increases the active surface area, improves electron mobility, and provides superior oxygen-reduction efficiency compared to traditional gold coatings. Testing under the Mixed Flowing Gas (MFG) and Low-Level Contact Resistance (LLCR) protocols confirms that the Nano-Au25 layer maintains excellent corrosion resistance and stable conductivity over extended environmental exposure. The dual-layer configuration generated by the current method therefore meets the performance standards of ASTM B488 while achieving significant material savings. The process enables a reduction in gold usage of more than half without degradation of surface durability or electrical integrity. In addition to material efficiency, the electrochemical characteristics of the Nano-Au25 surface contribute to improved conductivity, lower contact resistance, and greater thermal stability. The reaction conditions established by the current method also allow for reproducible nanoparticle growth and can be digitally controlled to ensure uniform deposition across complex geometries and connector assemblies.

The improved structure shown in FIG. 3 represents the practical realization of the inventive concept disclosed herein. Through the combination of a reduced conventional gold layer and a nanostructured gold-particle surface, the present invention achieves the same or better functional outcomes as traditional full-thickness coatings shown in FIG. 2. This advancement provides a cost-effective, scalable, and environmentally sustainable process suitable for high-performance electronics, connector systems, and semiconductor components requiring precision gold electrodeposition.

Electrolytic Solution Composition

In one embodiment, the electrodeposition process utilizes a meticulously formulated electrolytic solution composed of a gold phosphate base, enhanced by the inclusion of borohydride additives. This formulation is specifically designed to facilitate the essential redox reactions that drive nanoparticle formation, optimizing the nucleation and growth phases critical to the production of uniform, high-quality nanoparticles.

The electroplating bath, referred to as Mother Solution A, contains:

Potassium Dicyanoaurate: 0.7 g/L to 1.0 g/L
Disodium Phosphate: 5.0 g/L to 40.0 g/L
Phosphoric Acid (15%): 5.0 g/L to 45.0 mL/L
Calcium Disodium EDTA: 0.5 g/L to 5.0 mL/L
TRIS Hydrochloride: 5.0 g/L to 50.0 g/L This electrolytic solution is maintained at a pH of 7-9 at room temperature. The pH is carefully controlled throughout the electroplating process to optimize nanoparticle growth and ensure stability within the electroplating bath.

Figure 4:
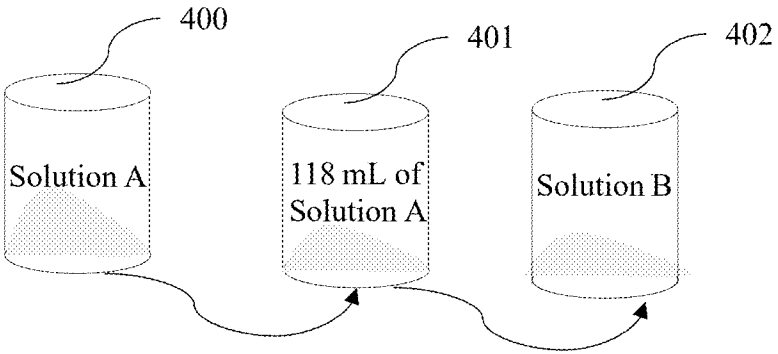
FIG. 4 is a schematic diagram showing preparation of the dual-layer electroplating system.

As illustrated in FIG. 4, a measured volume of the prepared Mother Solution A 400 is transferred to form the Nano-Au25 plating solution (Solution B) 402. This figure demonstrates the sequential preparation process in which approximately 118 mL (4 oz) of Mother Solution A, 401 is combined with the additional reagents to produce the Nano-Au25 electrolyte from which gold nanoparticles are synthesized.

To create the Nano-Au25 (nano gold solution B), the following components are incorporated:

Mother Solution A: 118 mL (4 oz) to 296 mL (10 oz)
Sodium Borohydride (NaBH4): 0.12 g/L to 0.14 g/L
Gold Chloride: 2.3 mL to 3.5 mL/L
Sodium Cyanide (2.5% wt/v): 2.5 mL to 4.5 mL/L
pH Range: 12-14
Temperature Range: 140° F. to 160° F.

Agitation or mechanical stirring during deposition is employed to enhance uniformity and deposition rate. Gold chloride concentration may be automatically adjusted in real time based on nanoparticle size feedback using in-situ monitoring sensors.

During the electroplating process, an oxidation reaction occurs in the solution, with sodium borohydride serving as a reducing agent. The reaction is further supported by the inclusion of gold chloride (2.0 mL/L to 8.0 mL/L) and sodium cyanide (2.5% wt/v), resulting in optimal conditions for nanoparticle synthesis. Unique electroplating parameters are utilized, including pH levels ranging from 10 to 14 and temperatures from 130° F. to 160° F., employing platinized titanium anodes with a direct current density of 7-10 ASF. This carefully regulated environment promotes efficient electrochemical reactions, enhancing the rate of reaction with increases in reductant concentration and temperature.

Electrodeposition Apparatus and Methodology

Figure 5:
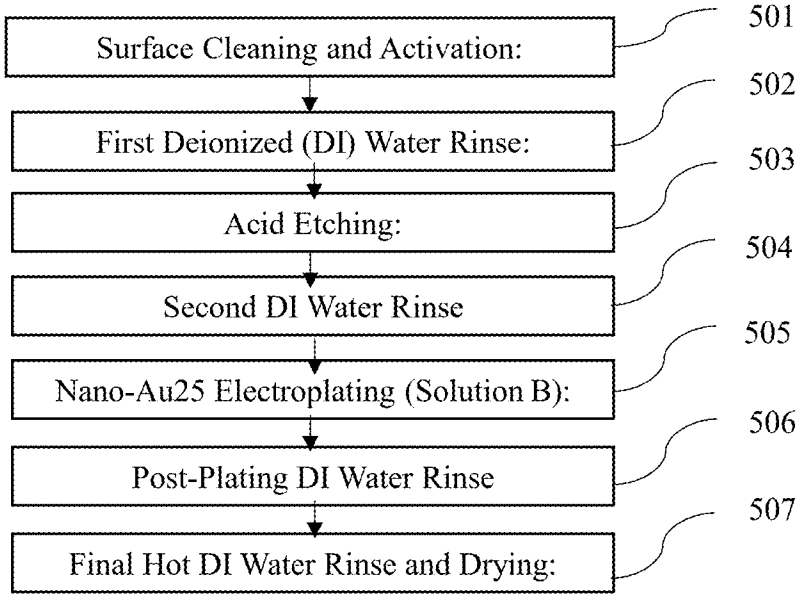
FIG. 5 is a process flow representation of the electrodeposition apparatus and operations used to form the Nano-Au25 layer.

The process sequence used for depositing the Nano-Au25 layer 305 is illustrated in FIG. 5. This figure depicts the complete sequence of operations through which the prepared substrate passes during the electrodeposition process. The procedure begins with surface cleaning and activation 501, wherein the substrate is immersed in a heated soak cleaner maintained at approximately 140° F. to remove surface contaminants and activate the metallic surface.

The cleaned substrate then undergoes a first hot deionized (DI) water rinse 502 at approximately 160° F. to ensure all residue from the cleaning stage is eliminated. Next, the substrate is subjected to acid etching 503 using a 10 percent hydrochloric or sulfuric acid bath maintained between 120° F. and 140° F. to enhance surface roughness and improve adhesion for subsequent layers. Following etching, a second DI water rinse 504 is performed to remove any remaining acidic solution. The substrate is then immersed in the Nano-Au25 plating solution (B) 505, maintained at 140° F. to 160° F., where electrochemical oxidation-reduction reactions occur in the presence of borohydride ions to form and deposit the nanometric "golden" gold particles on the substrate surface.

After electroplating, a post-plating DI water rinse 506 removes residual electrolyte and by-products. Finally, a hot DI water rinse and drying step 507 complete the process, yielding a uniform and adherent Nano-Au25 nanoparticle layer 305 exhibiting enhanced electrical and surface characteristics.

In some embodiments, the apparatus employed for the electrodeposition process is equipped with advanced monitoring systems that provide precise control over key electroplating parameters, including pH, temperature, and current density.

By carefully adjusting these parameters, the method 100 ensures optimal deposition of "golden" gold nanoparticles, significantly enhancing their structural and functional characteristics. This controlled environment is critical for achieving consistent quality and performance of the nanoparticles throughout the entirety of the electroplating process.

The electrodeposition apparatus is equipped with advanced monitoring systems for real-time feedback control of pH, temperature, and current density.

These monitoring systems include potentiometric pH sensors, current sensors, and temperature probes integrated with a feedback loop mechanism. The sensors provide continuous data signals to a microcontroller-or PLC-based control unit that automatically adjusts current density, gold chloride concentration, and bath temperature as required.

Temperature is controlled using a heated electrolyte bath maintained between 140° F. and 160° F. to stabilize Nano-Au25 particle formation.

Nanoparticle Characterization Process

In a preferred embodiment, the morphological and topographical characteristics of the synthesized nanoparticles are assessed using high-resolution Scanning Electron Microscopy (SEM) and Energy Dispersive X-Ray Spectroscopy (EDS). These analytical techniques confirm the superior structural properties of the "golden" gold nanoparticles, ensuring their compliance with stringent specifications required for advanced applications.

The oxidation-reduction (redox) process is characterized using analytical techniques. In one embodiment, potentiometric and cyclic-voltammetry analyses are performed to optimize reduction potential and deposition rate for the borohydride-driven gold plating reaction. These supplement structural verification using SEM, EDS, and XRF.

The elemental composition of the deposited "golden" gold nanoparticles was confirmed through X-ray fluorescence (XRF) spectroscopic analysis. The analysis exhibited distinct Au L$\alpha$ and Au L$\beta$ emission peaks, characteristic of metallic gold, thereby verifying the successful formation and deposition of gold nanoparticles on the plated surface. The XRF spectrum demonstrated consistent high-intensity gold signals, with minimal background interference, indicating a uniform nanoparticle distribution and strong surface adherence. These spectral results confirm the presence of nanoscale gold within the deposited layer and provide critical validation of the electrochemical synthesis process.

The present invention ensures that nanoparticles remain within a precisely controlled nanometric size range. This dimensional precision contributes to substantial improvements in the performance and efficiency of the resultant gold layers, particularly in electronic configurations. Characterization establishes three or four distinct sizes of gold nanoparticles (12 nm, 30 nm, and 45 nm), with some particles reaching sizes up to 60 nm. These sizes are a result of the redox reaction in the Nano-Au 25 phosphate solution conducted at 140° F. and pH 12, with sodium borohydride concentrations ranging from 0.02-0.6 g/L. Spectrophotometric analysis conducted at a wavelength of 450 nm has corroborated the presence of gold nanoparticles, affirming their successful synthesis.

Enhanced Properties and System Integration

In some embodiments, the "golden" gold nanoparticles exhibit enhanced oxygen reduction efficiency, demonstrating reaction rates up to five times greater than those of traditional gold deposits. This heightened reactivity is vital in electronic applications where superior electrochemical performance is imperative.

The resulting nanoparticles exhibit enhanced oxygen reduction efficiency and conductivity.

Electrical testing confirms that the Golden-Nano-Particle layers possess significantly improved conductivity values compared to conventional gold films, making them suitable for high-current electronic components.

Figure 6:
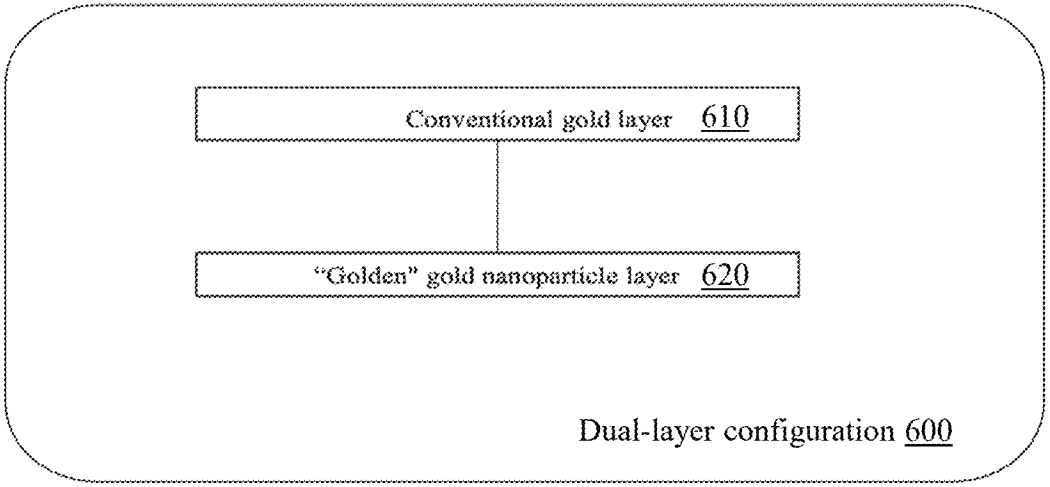
FIG. 6 is a schematic representation of the final dual-layer electroplated structure.

The dual-layer configuration 600, as shown in FIG. 6—comprising a thinner gold layer under a nanoparticle coating—retains full compliance with ASTM standards while achieving material savings of at least 60%.

The Golden-Nano-Particle electroplating method and formulations described herein are specifically applied in high-performance electronic, semiconductor, and connector devices, including those fabricated from beryllium copper, phosphor bronze, and other copper alloys.

Testing and Performance Metrics

Experimental evaluation of the current-carrying capacity demonstrated that the "golden" gold nanoparticle (Nano-Au25) layer exhibited superior electrical performance compared to conventional gold-plated deposits. The Nano-Au25 layer maintained a higher maximum current capacity across a wide range of ambient temperatures, confirming its stability and conductivity under elevated thermal conditions. Comparative current-temperature analyses showed that the nanoparticle coating sustained effective conduction with reduced derating relative to traditional gold finishes. Furthermore, the gold nanoparticle coating successfully passed all industry-standard qualification tests, including the Mixed Flowing Gas (MFG) Test, Gas Tight Test, Signal Integrity Test, and Low-Level Contact Resistance (LLCR) Test, verifying its reliability and suitability for high-performance electronic applications.

Thickness and Material Savings

In a preferred embodiment, an innovative dual-layer system is employed, integrating a conventional gold layer with a subsequently deposited "golden" nanoparticle layer. This configuration adheres to ASTM gold standards while effectively reducing the total thickness of the gold deposit by 50%. The system consists of copper alloys layered with nickel and a crystalline layer of gold strike and gold, reduced in thickness to ensure substantial material savings and enhanced economic efficiency in semiconductor manufacturing contexts.

The novel electroplating process disclosed herein ensures that the maximum thickness of the "golden" nanoparticle layer does not exceed 3 microinches (0.075 microns). Despite this reduced thickness, the properties achieved are comparable to traditional gold plating thicknesses ranging from 50 microinches (1.25 microns) to 100 microinches (2.5 microns), depending on the product utilized. This innovation results in substantial material savings and cost reductions, enhancing the overall viability of gold nanoparticles in high-performance applications.

In summary, the present invention provides a comprehensive method for the electrodeposition of gold nanoparticles, encompassing the utilization of a gold phosphate solution with borohydride additives as an electrolyte; meticulous control of parameters such as pH, temperature, and current density; and the execution of an electrodeposition process characterized by oxidation-reduction reactions yielding nanometric-scale "golden" gold nanoparticles. In such embodiments, the resulting nanoparticles display enhanced oxygen reduction characteristics on their surfaces, demonstrating performance improvements of up to five times compared to conventional gold surfaces.

Furthermore, as shown in FIG. 6, the present invention introduces a dual-layer gold deposit system that combines a conventional gold layer 610 with a subsequently deposited "golden" gold nanoparticle layer 620, configured to meet ASTM standards while significantly reducing overall thickness and improving material-use efficiencies. This invention represents a significant advancement in electroplating technology, providing substantial improvements in efficiency, material savings, and cost-effectiveness for applications requiring high-performance electronic components.

Although the invention has been explained in relation to its preferred embodiment, it is to be understood that many other possible modifications and variations can be made without departing from the spirit and scope of the invention.

What is claimed is:

1. A formulation for producing a Nano-Au25 electrolytic solution used in the electrodeposition of "Golden Nano-Particles," characterized the formulation comprising:

a mother solution A, comprising:

potassium dicyanoaurate at a concentration of 0.7 g/L to 1.0 g/L;

disodium phosphate at a concentration of 5.0 g/L to 40.0 g/L;

phosphoric acid comprising a 15% weight by volume (w/v) phosphoric acid solution at a concentration of 5.0 g/L to 45.0 g/L;

calcium disodium EDTA at a concentration of 0.5 g/L to 5.0 g/L; and

TRIS hydrochloride at a concentration of 5.0 g/L to 50.0 g/L, wherein the mother solution A maintains a pH of 7 to 9 at room temperature, wherein the mother solution A at a concentration ranging from 118 mL/L to 296 mL/L, is combined with:

sodium borohydride at a concentration of 0.12 g/L to 14 g/L;

gold chloride at a concentration of 2.3 mL/L to 3.5 mL/L; and sodium cyanide comprising a 2.5% w/v of sodium cyanide solution at a concentration of 2.5 mL/L to 4.5 mL/L, to form a Nano-Au25 solution B, which is the Nano-Au25 electrolytic solution produced by the formulation, from which the Golden Nano-particles are synthesized, wherein the Golden Nano-Particles are gold nanoparticles referred to as golden gold nanoparticles and designated as Nano-Au25 gold nanoparticles, wherein the Nano-Au25 solution B has a pH of 12 to 14 and optimized forelectrodeposits a layer of the Nano-Au25 gold nanoparticles onto a surface of a substrate at a deposition rates of 3.0 μm/h-to 4.0 μm/h.

2. The formulation of claim 1, wherein the Nano-Au25 electrolytic solution improves the stability and performance of electrodeposited Nano-Au25 gold nanoparticles by facilitating electrochemical reduction- oxidation reactions referred to as redox reactions that drive the nucleation and growth phases during electrodeposition for uniform and high-quality production of the Nano-Au25 gold nanoparticles onto the surface of the substrate, wherein the Nano-Au25 gold nanoparticles have particle sizes ranging from 12 nanometers (nm) to 60 nm, and wherein the redox reactions are driven by an externally applied electrical current passing between an anode and a cathode.

3. The formulation of claim 1, wherein the Nano-Au25 electrolytic solution is mixed by agitation or mechanical stirring during the electrodeposition of the Nano-Au25 gold nanoparticles onto the surface of the substrate to enhance homogeneity, uniformity, and deposition rate.

4. The formulation of claim 1, wherein the Nano-Au25 electrolytic solution is maintained at temperatures atranging from 130°F to 160°F and PH levels ranging from 10 to 14 during the electrodeposition processof the Nano-Au25 gold nanoparticles onto the surface of the substrate, by employing platinized titanium anodes with a direct current density ranging from 7 to 10 Amperes per Square Foot (ASF).

5. The formulation of claim 1, wherein the formulation produces the Nano-Au25 electrolytic solution for electrodeposition of the Nano-Au25 gold nanoparticles onto the surface of the substrate by producing a dual-layer of gold deposits, comprising a conventional gold layer, and a Nano-Au25 gold nanoparticle layer as a thin layer over the underlying conventional gold layer, wherein the Nano-Au25 gold nanoparticle layer exhibits enhanced conductivity, oxygen reduction efficiency, and maintains excellent corrosion resistance properties compared to traditional gold coatings, which is crucial for applications in high-performance electronic devices, and wherein the dual-layer gold deposits demonstrate reaction rates up to five times greater than those of traditional gold deposits in accordance with ASTM B488 standards, exhibit reduced required thickness of the conventional gold layer in the dual-layer of gold deposits by at least 50% compared to traditional gold deposits owing to the application of the Nano-Au25 gold nanoparticle layer while adhering to the ASTM B488 standards, producing a reduction in the required total gold content by 50% to 60% compared to traditional gold deposits.

6. The formulation of claim 1, wherein the formulation produces the Nano-Au25 electrolytic solution for electrodeposition of the Nano-Au25 gold nanoparticles onto the surface of the substrate produces coatings on high-performance electronics that successfully pass industry standard qualification tests, including the Mixed Flowing Gas (MFG) Test, Gas Tight Test, Signal Integrity Test, and Low Level Contact Resistance (LLCR) Test, verifying its reliability and suitability for high-performance electronic applications in high performance electronic, semiconductor, and connector devices, including those fabricated from beryllium copper, phosphor bronze, and other copper alloys.

* * * * *